United States Patent [19]

Davis

[11] Patent Number: 4,905,431

[45] Date of Patent: Mar. 6, 1990

[54] FLOORING EDGE FINISHER

[75] Inventor: Robert J. Davis, Stockport, United Kingdom

[73] Assignee: Ferodo Limited, Great Britain

[21] Appl. No.: 134,504

[22] Filed: Dec. 16, 1987

[30] Foreign Application Priority Data

Dec. 24, 1986 [GB] United Kingdom ..... 8630879

[51] Int. Cl.[4] ..... B44D 5/08

[52] U.S. Cl. ..... 52/179; 52/177; 52/181

[58] Field of Search ..... 52/177, 179, 181

[56] References Cited

U.S. PATENT DOCUMENTS

| | | | |
|---|---|---|---|
| 3,334,456 | 8/1907 | Naka | 52/181 X |
| 4,662,972 | 5/1987 | Thompson | 52/181 X |
| 4,796,402 | 1/1989 | Pajala | 52/390 |

FOREIGN PATENT DOCUMENTS

| | | | |
|---|---|---|---|
| 1041 | of 1899 | United Kingdom | 52/177 |

*Primary Examiner*—David A. Scherbel
*Assistant Examiner*—Creighton Smith
*Attorney, Agent, or Firm*—Nixon & Vanderhye

[57] ABSTRACT

A flooring edge finisher which is of multi-piece construction. There are at least three components which include a friction insert plus base unit, and two edge pieces. The edge pieces interlock with, and conceal the base part of, the friction insert plus base unit.

10 Claims, 3 Drawing Sheets

FLOORING EDGE FINISHER

Figure 1:
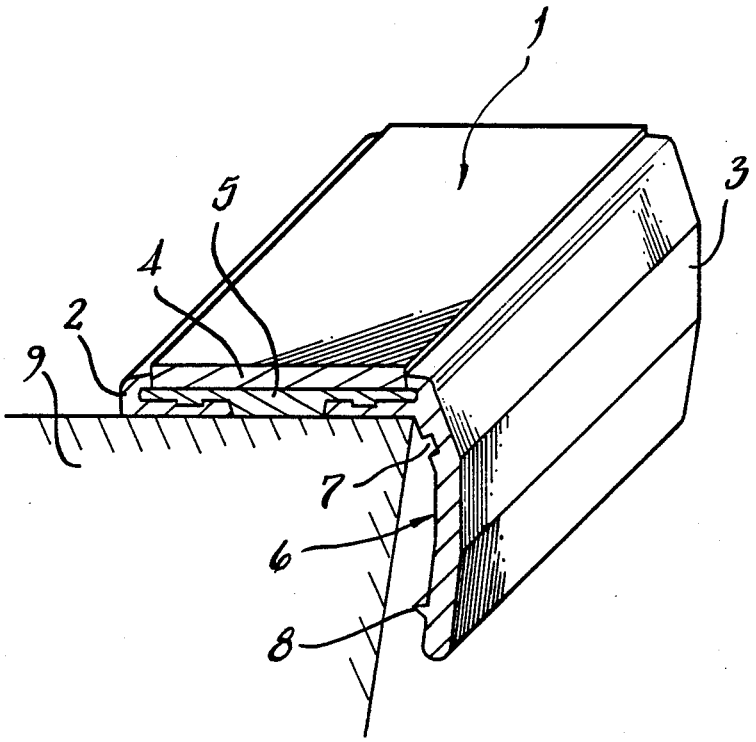

This invention relates to a flooring edge finisher, and more particular to such a finisher of multi-piece construction.

Flooring edge finishers are in widespread use where floor coverings come to edges which would be exposed and offer opportunity for rapid wear of the covering, fraying of the edge or tripping of persons walking over it. Edges which are particularly vulnerable are for example, steps and the interface between a polished dance floor and adjacent carpeted area.

Multi-piece edge finishers are known, for example from UK Patent No. 1,578,528 in which there is disclosed a step nosing comprising a tread engaging member and a riser member which are secured together at their interface. This construction will permit a variety of riser members to be used with one basic tread member but if various colours are to be used coloured matched pairs of the members have to be stocked.

Multi-piece floor coverings are also known, for example from UK Patent No. 1,551,295 in which deformable elongate floor covering elements are connected by connecting strips in parallel, side by side, arrangement.

The present invention provides a new edge finisher based on a friction insert unit which can be used in various different configurations by addition of suitable further components.

According to the present invention a multi-piece flooring edge finisher comprising at least three components, including a first component which consists of friction insert plus a base member, and two components which are edge pieces, wherein the edge pieces and said first component have interlocking complementary shapes facilitating connection between them in a manner such that in use of the finisher the friction insert is exposed 10 but the base member is concealed from view by the edge pieces, said components when connected forming a substantially rigid coherent structure.

The first component consisting of a friction insert plus base member may be a single extrusion of a suitable material, for example a pvc or rubber compound, or may be a co-extrusion of a high friction material for the insert with a base of a different, more rigid plastics or rubber material. Alternatively the friction insert may be of a plastics or rubber material which is adhered or otherwise firmly attached to a base of quite different material such as a metal, for example aluminium. The friction insert is preferably a rubber or plastics material containing suitable fillers and friction modifiers to enhance its anti-slip properties. Such materials are, for example, silicaceous fillers, carbon block, aluminium oxide, antimony sulphide.

The cross-sectional profile of the first component is carefully chosen to permit edge pieces which interlock with it to be attached to each edge without need of adhesive. The edge pieces can be a snap-fit or slide fit on the first component, preferably a snap fit, but a coherent substantially rigid structure must result for convenient handling and necessary strength in use.

The edge pieces may be of plastic materials such as pvc, or may be of metal, for example aluminium, and they are preferably extrusions.

One edge piece may extend away from the plane of the friction insert plus base unit at a suitable angle to provide a step nosing.

In this case additional supporting fitments may be provided to further support the edge piece. For instance, where an edge piece is to be used to form a step nosing, and it is desired to provide a space behind the nosing for a carpet on a step riser, an additional bracing block may be provided beneath the edge piece which will extend down the step riser.

Other edge pieces may be provided to fulfil various functions such as to cover and grip a carpet edge, to provide a sloping ramp from the friction insert to a polished floor, or to abut the edge of a tiled surface. An edge piece which is adapted to link together two friction inserts and base units may also be provided.

It is preferred that all the three components of the flooring edge finisher are so shaped as to provide support surfaces which will contact the floor on which the edge finisher is to be used. This is particularly desirable where the edge finisher is to be a step nosing.

Preferably the components provide a substantially continuous support surface on the underside of the edge finisher, ie that section of it which is to abut a floor surface in a horizontal plane. The support surface provided may be grooved especially if it is to be used with adhesive, to provide a good key for the adhesive.

Figure 2:
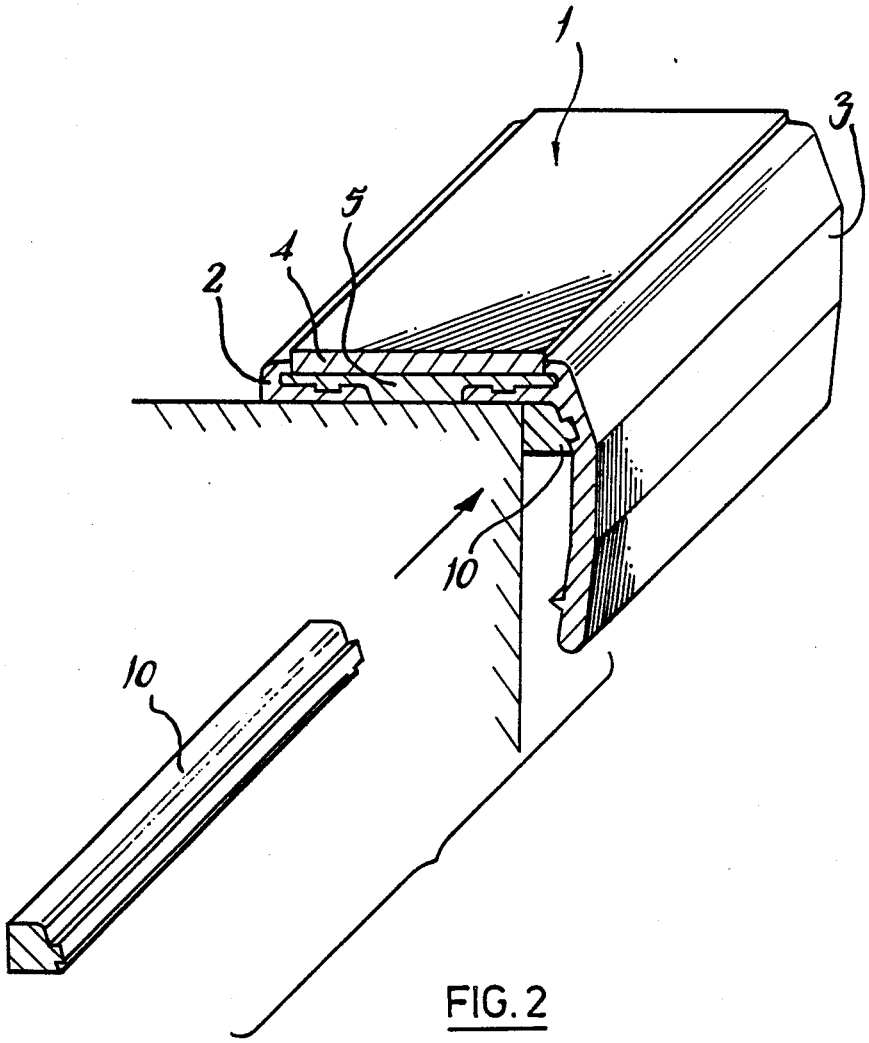
Figure 3:
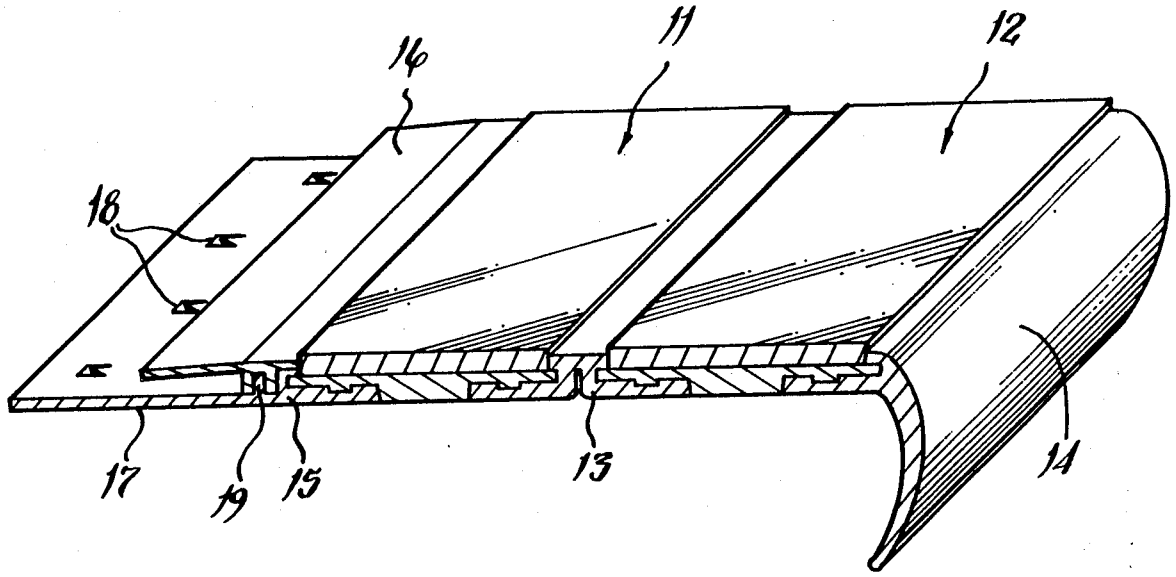

The invention will now be described in more detail by way of example with reference to the accompanying schematic drawings in which FIG. 1 is a sectioned perspective view of a simple stair nosing in accordance with the invention, FIG. 2 is a similar view of a modification of the embodiment of FIG. 1 and FIG. 3 is a sectioned perspective view of a stair nosing having two friction inserts and incorporating a carpet gripper.

The embodiment shown in FIG. 1 consists of first component 1 consisting of a friction insert 4 and base unit 5, and two other components which are a simple edge piece 2, and an edge piece 3 which takes the form of a riser to provide a stair nosing arrangement on a step 9.

The first component 1 includes a friction insert 4 of, for example, an abrasion resistant high friction pvc compound, and co-extruded therewith, a base 5 or a more rigid compound. The profile of the edges of the first component 1 is shaped to provide a form of dovetail cross section which facilitates snap-fitment of edge pieces of interlocking profile. The base 5 is a shallow 'T' shape in cross section with protrusions on the arms of the 'T' to provide the snap fit.

The edge piece 2 snap fits on to the first component 1, conceals the base 5 and provides a flat abutment surface for, for example, a tiled floor.

The edge piece 3 snap fits onto the first component 1 in the same fashion, but is shaped to extend away from the plane of the friction insert 4 to form a riser for a step nosing. The inner face 6 of the riser portion of the edge piece 3 is provided with a dovetail groove 7 to facilitate fitment of a bracing block should this be necessary, and with a sharp ridge 8 which will help to retain a floor covering in position on the riser of a step. It will be noted that the three components together provide a substantially continuous surface on the underside of the nosing to rest on the step 9.

In the modification shown in FIG. 2 the step nosing of FIG. 1 is mounted on a step with a 90° angle so that the nosing has to overhang the step to leave room for a carpet behind the riser portion of the edge piece 3. In this situation a bracing block 10 is provided to reinforce the edge piece 3 beneath the overhang.

The embodiment shown in FIG. 3 is a stair nosing which includes two similar first components 11 and 12 each consisting of a friction insert and base unit. These are linked by a special double-sided edge piece 13, and the arrangement is completed by an edge piece 14 forming the riser portion of the nosing and an edge piece 15 is the form of a carpet gripper with a clip-on cover 16.

In this case the components 14, 12, 13, 11 and 15 all snap-fit together to form a coherent structure serving as a stair nosing and in this case the edge piece 14 is shaped to form a very simple curved riser portion. The components again provide a substantially continuous support surface on the underside of the nosing.

The edge piece 15 has a wide extended base 17 facilitating the provision of tangs 18 to grip the underside of a carpet. The preferred material for this edge is a metal such as aluminium, and so in order to conceal the metal the separate clip-on cover 16 is provided, and an upstanding bar 19 on the edge onto which the cover 16 may be clipped.

The preferred material for the edge pieces 2, 3, 13 and 14 and the clip-on cover 16 illustrated in these drawings is uPVC which is available in a range of colours and has good properties for producing accurate extrusions of adequate strength. Other materials may, however, be used if desired, such as other thermoplastics, or aluminium.

It will be noted that in the embodiments shown the friction insert plus base unit will rest directly upon the step or floor, trapping a part of the edge pieces against that surface. This is the preferred arrangement. The edge finisher will often be secured to the floor or step by means of adhesive, and the back face of the edge pieces and friction insert plus base unit should therefore be substantially flat although they may be roughened or slightly grooved to provide a key for the adhesive.

Where the edge finisher is a step nosing and is to be secured to a step by means of point fixings such as nails or screws it is preferred that at least some of such fixings be positioned such that they extend through a portion of that edge piece forming the riser of the nosing eg edge piece 14 in FIG. 3. It will be appreciated that the relative dimensions of the components may be adjusted to make this easier, eg by making the first component assymetric with the wider edge piece forming the riser.

I claim:

1. A multi-piece flooring-edge finisher comprising at least three components, including a first component which consists of friction insert and a base member, and two components which are edge pieces, wherein the edge pieces and the base member of said first component have interlocking complementary shapes facilitating connection between them in a manner such that in use of the finisher the friction insert is exposed but the base member is concealed from view by the edge pieces, said three components when connected forming a substantially rigid coherent structure, and said three components being supported directly on a floor when in use.

2. An edge-finisher according to claim 1 in which the underside of the edge finisher, which is in contact with a floor when in use, takes the form of a substantially continuous support surface.

3. An edge finisher according to claim 1, wherein one of the edge pieces extends in a plane away from the plane of the friction insert at a suitable angle to form a step nosing.

4. An edge finisher according to claim 1 in which said first component is a co-extrusion of two different materials.

5. An edge finisher according to claim 1 in which said base member is of a metal such as aluminium, and the edge pieces are of rubber or plastics material.

6. An edge finisher according to claim 1 in which said base member is of rubber or plastics material and the edge piece of aluminium.

7. An edge finisher according to claim 1 in which in the first component the base member has a cross-sectional shape in the form of a shallow 'T' having projections on the arms of the 'T' and the edge pieces envelop the ends of the arms of the 'T' and have portions extending beneath the arms of the 'T' to the stem of the 'T', shaped to facilitate a snap—or slide—fitting connection between the edge pieces and the base member.

8. An edge finisher according to claim 7 wherein the edge finisher is a step nosing and the first component is asymmetric, the 'T' cross-sectional shape of the base member having a longer arm on that side of the 'T' which will be adjacent to the step edge when in use.

9. A multi-piece flooring-edge finisher comprising at least three components, including a first component which consists of friction insert and a base member, and two components which are edge pieces, wherein the edge pieces and the base member of said first component have interlocking complementary shapes facilitating connection between them in a manner such that in use of the finisher the friction insert is exposed but the base member is concealed from view by the edge pieces, said three components when connected forming a substantially rigid coherent structure, wherein one of the edge pieces extends in a plane away from the plane of the friction insert at a suitable angle to form a step nosing having an additional bracing block beneath that edge piece which, in use, will extend down the step riser.

10. A multi-piece flooring-edge finisher comprising at least three components, including a first component which consists of friction insert and a base member, and two components which are edge pieces, wherein the edge pieces and the base member of said first component have interlocking complementary shapes facilitating connection between them in a manner such that in use of the finisher the friction insert is exposed but the base member is concealed from view by the edge pieces, said three components when connected forming a substantially rigid coherent structure and further comprising an edge piece which incorporates a carpet gripper.

* * * * *